US009044967B2

(12) United States Patent
Kueckendahl et al.

(10) Patent No.: US 9,044,967 B2
(45) Date of Patent: Jun. 2, 2015

(54) MARKING APPARATUS AND MARKING METHOD

(75) Inventors: Peter Joerg Kueckendahl, Bad Oldesloe (DE); Daniel Joseph Ryan, Sycamore, IL (US)

(73) Assignee: ALLTEC ANGEWANDTE LASERLICHT TECHNOLOGIE GMBH, Selmsdorf (DE)

( * ) Notice: Subject to any disclaimer, the term of this patent is extended or adjusted under 35 U.S.C. 154(b) by 0 days.

(21) Appl. No.: 13/977,156

(22) PCT Filed: Dec. 22, 2011

(86) PCT No.: PCT/EP2011/006522
§ 371 (c)(1),
(2), (4) Date: Jun. 28, 2013

(87) PCT Pub. No.: WO2012/089327
PCT Pub. Date: Jul. 5, 2012

(65) Prior Publication Data

US 2013/0300816 A1 Nov. 14, 2013

(30) Foreign Application Priority Data

Dec. 30, 2010 (EP) ..... 10016195

(51) Int. Cl.
*B41J 2/515* (2006.01)
*B41J 25/00* (2006.01)
(Continued)

(52) U.S. Cl.
CPC *B41J 2/451* (2013.01); *B41J 2/447* (2013.01); *B41J 2/46* (2013.01); *B41J 2/515* (2013.01); *B41J 25/003* (2013.01); *B41J 2/45* (2013.01)

(58) Field of Classification Search
CPC ..... B41J 2/45; B41J 2/46; B41J 2/447; B41J 2/515; B41J 25/003
USPC ..... 347/234, 238, 241
See application file for complete search history.

(56) References Cited

U.S. PATENT DOCUMENTS 4,707,063 A * 11/1987 Plummer ..... 385/79
5,399,032 A 3/1995 Itoh et al.
(Continued)

FOREIGN PATENT DOCUMENTS

DE 2401322 A1 7/1975
DE 3826113 A1 2/1989
(Continued)

OTHER PUBLICATIONS

International Application No. PCT/EP2011/006522, Written Opinion of International Search Authority.
(Continued)

*Primary Examiner* — Sarah Al Hashimi
(74) *Attorney, Agent, or Firm* — Hoffman Warnick LLC

(57) ABSTRACT

The invention relates to a making apparatus for making an object comprising—a marking head (20) having a plurality of receiving spaces (24) for individual marking devices (40) and—a driving mechanism for providing a relative movement of the object (8) relative to the marking head (20) in an advance direction (16), wherein—the receiving spaces (24) are arranged in a plurality of rows (30) and columns (32), such that an array (22) of receiving spaces (24) with a rectangular pattern of the receiving spaces (24) is formed, and—the array (22) of receiving spaces (24) is tilted with regard to the advance direction (16)—the marking head (20) comprises a receiving plate (28) having a plurality of receiving holes (26) formed as through-holes therein, the receiving holes (26) forming the receiving spaces (24) for the individual marking devices (40),—the marking devices (40) each include a ferrule (42) which is insertable into a receiving hole (26) of the receiving plate (28), and—the receiving holes (26) are formed to tightly and removably hold the individual ferrules (42) therein.

13 Claims, 23 Drawing Sheets

(51) Int. Cl.

| | |
|---|---|
| ***B41J 2/45*** | (2006.01) |
| ***B41J 2/46*** | (2006.01) |
| ***B41J 2/447*** | (2006.01) |

(56) References Cited

U.S. PATENT DOCUMENTS

| | | | | |
|---|---|---|---|---|
| 5,477,259 | A | 12/1995 | Iwasa | |
| 5,777,634 | A | 7/1998 | Okamura et al. | |
| 5,784,098 | A | 7/1998 | Shoji et al. | |
| 6,189,991 | B1 | 2/2001 | Wen et al. | |
| 6,286,927 | B1 | 9/2001 | Taneya et al. | |
| 6,381,377 | B1 | 4/2002 | Wang | |
| 6,469,729 | B1 | 10/2002 | Ryan | |
| 6,738,086 | B2 * | 5/2004 | Oka | 347/241 |
| 6,855,921 | B1 | 2/2005 | Stopperan et al. | |
| 7,354,130 | B2 | 4/2008 | Arakawa | |
| 7,448,719 | B1 | 11/2008 | Newell | |
| 7,564,020 | B2 | 7/2009 | Sergyeyenko | |
| 7,671,337 | B1 * | 3/2010 | Tidwell | 250/339.11 |
| 7,908,968 | B2 | 3/2011 | McCoin et al. | |
| 2002/0001004 | A1 | 1/2002 | Mantell et al. | |
| 2002/0101469 | A1 | 8/2002 | Wade et al. | |
| 2002/0109741 | A1 | 8/2002 | Okabe et al. | |
| 2002/0139273 | A1 | 10/2002 | Murata et al. | |
| 2002/0191069 | A1 | 12/2002 | Oka | |
| 2003/0016348 | A1 | 1/2003 | Sallee | |
| 2003/0210861 | A1 | 11/2003 | Weiss et al. | |
| 2003/0235373 | A1 * | 12/2003 | Ishii et al. | 385/78 |
| 2004/0160478 | A1 | 8/2004 | Weijkamp et al. | |
| 2005/0122548 | A1 | 6/2005 | Cunnigan et al. | |
| 2005/0123303 | A1 | 6/2005 | Guttman et al. | |
| 2005/0140770 | A1 | 6/2005 | Kang et al. | |
| 2005/0286093 | A1 | 12/2005 | Sumi et al. | |
| 2006/0066924 | A1 * | 3/2006 | Delueg | 358/506 |
| 2006/0109525 | A1 | 5/2006 | Evans | |
| 2007/0091132 | A1 | 4/2007 | Lim | |
| 2007/0279713 | A1 | 12/2007 | Feng et al. | |
| 2008/0055352 | A1 | 3/2008 | Toh et al. | |
| 2008/0246962 | A1 | 10/2008 | Yang | |
| 2010/0002057 | A1 | 1/2010 | Hatasa et al. | |
| 2010/0214387 | A1 | 8/2010 | Fox et al. | |
| 2010/0231929 | A1 | 9/2010 | Kakigi | |
| 2013/0021398 | A1 | 1/2013 | Mizes | |
| 2013/0286147 | A1 | 10/2013 | Kueckendahl et al. | |
| 2013/0286148 | A1 | 10/2013 | Kueckendahl et al. | |
| 2013/0286149 | A1 | 10/2013 | Kueckendahl et al. | |
| 2013/0293658 | A1 | 11/2013 | Kueckendahl et al. | |
| 2013/0328978 | A1 | 12/2013 | Sekino et al. | |
| 2013/0342823 | A1 | 12/2013 | Kueckendahl et al. | |

FOREIGN PATENT DOCUMENTS

| | | | |
|---|---|---|---|
| EP | 0121369 | A2 | 10/1984 |
| EP | 0832752 | A2 | 4/1998 |
| EP | 0832754 | A1 | 4/1998 |
| EP | 1266763 | A1 | 12/2002 |
| EP | 1640169 | A2 | 3/2006 |
| EP | 2105309 | A1 | 9/2009 |
| JP | 05185686 | | 7/1993 |
| JP | 2001332806 | A | 11/2001 |
| JP | 2007090814 | A | 4/2007 |
| JP | 2008126471 | A | 6/2008 |
| JP | 2009037128 | A | 2/2009 |
| WO | 8505187 | | 11/1985 |
| WO | 2006037973 | A1 | 4/2006 |
| WO | 2007107030 | A1 | 9/2007 |
| WO | 2008104222 | A1 | 9/2008 |
| WO | 2009153795 | A1 | 12/2009 |

OTHER PUBLICATIONS

International Application No. PCT/EP2011/006522, International Report on Patentability.

U.S. Appl. No. 13/976,832, Notice of Allowance dated Jun. 24, 2014, 19 pages.

U.S. Appl. No. 13/976,832, Notice of Allowance dated Oct. 8, 2014, 61 pages.

U.S. Appl. No. 13/976,814, Notice of Allowance dated Oct. 21, 2014, 72 pages.

U.S. Appl. No. 13/976,809, Office Action dated May 27, 2014, 16 pages.

U.S. Appl. No. 13/976,804, Notice of Allowance dated Mar. 20, 2014, 19 pages.

U.S. Appl. No. 13/976,804, Office Action dated Jul. 8, 2014, 59 pages.

U.S. Appl. No. 13/976,804, Final Office Action dated Oct. 24, 2014, 18 pages.

U.S. Appl. No. 13/976,793, Office Action dated Jul. 1, 2014, 15 pages.

U.S. Appl. No. 13/977,151, Notice of Allowance dated Aug. 4, 2014, 17 pages.

U.S. Appl. No. 13/976,779, Notice of Allowance dated Oct. 21, 2014, 34 pages.

U.S. Appl. No. 13/977,159, Office Action dated Jun. 20, 2014, 11 pages.

U.S. Appl. No. 13/977,159, Final Office Action dated Oct. 10, 2014, 53 pages.

U.S. Appl. No. 13/976,793, Notice of Allowance dated Dec. 9, 2014, 66 pages.

U.S. Appl. No. 13/976,814, Notice of Allowance Dated Dec. 29, 2014, 10 pages.

International Application No. PCT/EP2011/006514, Written Opinion of International Search Authority.

International Application No. PCT/EP2011/006516, Written Opinion of International Search Authority.

International Application No. PCT/EP2011/006519, Written Opinion of International Search Authority.

International Application No. PCT/EP2011/006519, Preliminary Report on Patentability.

International Application No. PCT/EP2011/006520, Written Opinion of International Search Authority.

International Application No. PCT/EP2011/006521, Written Opinion of International Search Authority.

International Application No. PCT/EP2011/006521, Written Opinion of International Examining Authority.

International Application No. PCT/EP2011/006516, International Search Report, dated Mar. 23, 2012, 3 pages.

International Application No. PCT/EP2011/006515, International Preliminary Report on Patentability, Jan. 21, 2013.

International Application No. PCT/EP2011/006515, Written Opinion on Search Report.

International Application No. PCT/EP2011/00652023, Written Opinion of International Search Authority.

International Application No. PCT/EP2011/006518, Written Opinion of International Search Authority.

International Application No. PCT/EP2011/006517, Written Opinion of International Search Authority.

U.S. Appl. No. 13/977,159, Notice of Allowance, Feb. 17, 2015, 15 pages.

U.S. Appl. No. 13/977,151, Office Action, Feb. 17, 2015, 70 pages.

U.S. Appl. No. 13/976,804, Notice of Allowance, Feb. 3, 2015, 11 pages.

U.S. Appl. No. 13/976,793, Notice of Allowance, Feb. 4, 2015, 16 pages.

U.S. Appl. No. 13/976,779, Notice of Allowance, Feb. 6, 2015, 18 pages.

U.S. Appl. No. 13/976,809, Office Action, Feb. 6, 2015, 78 pages.

U.S. Appl. No. 13/976,779, Office Action dated Jun. 16, 2014, 13 pages.

* cited by examiner

MARKING APPARATUS AND MARKING METHOD

FIELD OF THE INVENTION

The present invention relates to a marking apparatus for marking an object comprising a marking head having a plurality of receiving spaces for individual marking devices and a driving mechanism for providing a relative movement of the object relative to the marking head in an advance direction during a marking operation.

The invention also relates to a method for marking an object, wherein a marking is applied by a plurality of individual marking devices and the object is moved relative to the marking devices in an advance direction during a marking operation.

RELATED ART

U.S. Pat. No. 6,295,080 B1 describes an image recording apparatus with a print head having a plurality of light emitting elements.

U.S. Pat. No. 6,232,997 B1 describes a colour print head which is movable in a main scanning direction and a sub-scanning direction relative to a printing paper. The print head includes a plurality of luminous elements arranged in the main scanning direction at right angles to a transport direction of the printing paper.

SUMMARY OF THE INVENTION

One object of the invention is to provide a marking apparatus allowing for a high marking speed and a high marking resolution.

The object is solved according to the invention by a marking apparatus and a method. Preferred embodiments are given in the dependent claims.

The marking apparatus is characterized in that the receiving spaces are arranged in a plurality of rows and columns, such that an array of receiving spaces with a rectangular pattern of the receiving spaces is formed, and the array of receiving spaces is tilted with regard to the advance direction such that the rows extend in a transverse direction relative to the advance direction and the receiving spaces of a successive row of the rectangular pattern are offset with regard to the receiving spaces of a preceding row of the rectangular pattern in a direction perpendicular to the advance direction.

One idea of the invention is to provide a marking head with a plurality of rows of receiving spaces for marking devices in order to enhance the speed of marking as compared to a marking head having only a single row of marking devices. The rows, in which the receiving spaces are arranged, extend in a transverse direction, that is, they extend transversely to the advance direction.

A further idea of the invention is to arrange at least a part of the receiving spaces of the marking head in a regular pattern of rows and columns, wherein the columns are perpendicular to the rows. Such a pattern is referred to as a rectangular pattern of receiving spaces. In the rectangular pattern, the receiving spaces are arranged in a manner, that in each case four receiving spaces are arranged in the edges of a rectangle. The rectangular pattern may also be referred to as an orthogonal arrangement of the receiving spaces. The receiving spaces are in particular arranged in a two-dimensional array or in a matrix.

It may be preferred that the receiving spaces are arranged in a regular pattern, in which the pitch of the receiving spaces, that is the distance between two central points of neighbouring receiving spaces in one row or column, is constant. More particularly, it may be preferred that a row pitch and column pitch are equal. The pitch of the receiving spaces of the marking head is also called the device pitch.

According to the invention the resolution of the marking head may be enhanced in that the rows of receiving spaces extend transversely, but not perpendicularly, to the advance direction. Consequently, the columns of receiving spaces also extend transversely to the advance direction. The array of receiving spaces is thus rotated or tilted from a position, in which the columns are aligned with the advance direction, to a position, in which the columns are inclined or slanted with regard to the advance direction. As the receiving spaces are arranged in a rectangular array, the rows are also inclined or slanted with regard to a direction perpendicular to the advance direction.

It may be preferred that the marking head is a page-wide marking head, that is the marking head has a width corresponding to the width of the marking to be applied. The width of the marking is defined as the dimension of the marking in the transverse direction. The marking may therefore be applied by moving the marking head in the advance direction without overlaying a further movement in the transverse direction. The advance direction, which may also be called the product movement direction, may be in particular a linear direction.

With the tilted marking head, the width of the marking is defined by a distance in a direction perpendicular to the advance direction between a first receiving space of a first row and a last receiving space of a last row, wherein the receiving spaces of the first row and the last row are numbered in the same direction. In other words, the marking width is defined by the distance in a direction perpendicular to the advance direction of two receiving spaces located diagonally opposite one another.

In a preferred embodiment of the marking head, the receiving spaces are arranged in a regular field having a fundamentally rectangular shape. By tilting the rectangular field of receiving spaces relative to the advance direction the marking resolution may be enhanced, while at the same time an easy manufacturing of the marking head is maintained.

Each of the receiving spaces may be equipped with at least one, in some particular cases exactly one, marking device for applying a marking onto the object to be marked. The marking devices can in particular be printing devices, so that the marking head may also be referred to as a printing head. Each of the marking devices may apply a single marking line extending in the product movement direction onto the object, while the object is moved in this direction. It is also possible to apply a single pixel by activating the marking device for only a short period of time.

In a preferred embodiment of the marking apparatus a tilting angle, which is defined as the angle between the columns and the advance direction, is smaller than 45 degrees. It may be preferred, that the tilting angle is in the range of 1 to 10 degrees, more preferably 2 to 8 degrees, even more preferably 2 to 5 degrees. In conjunction with an array of 32 times 32 receiving spaces the tilting angle is preferably about 2.7 degrees. The tilting of the array of receiving spaces may be achieved by tilting the marking head relative to the advance direction and/or by tilting the array relative to the marking head.

In a preferred embodiment of the invention, the receiving spaces are arranged in a regular rectangular pattern and the amount of offset of the receiving spaces of a successive row with regard to the receiving spaces of a preceding row is smaller than a pitch of the receiving spaces of one row. The amount of offset may in particular be the distance in a direction perpendicular to the advance direction between two corresponding receiving spaces of neighbouring or adjoining rows. The amount of offset corresponds to a print or marking line pitch.

In other words, a print or marking line pitch, that is a pitch of the marking lines or pixels in a direction perpendicular to the advance direction, may be preferably smaller than the device pitch of one row, that is the pitch of the receiving spaces/marking devices of one row. The columns of the array of receiving spaces are thus inclined so that a successive marking device of one column marks a pixel that is offset with regard to the advance direction compared to a pixel marked by a preceding marking device of the same column.

In the regular rectangular pattern, the pitch of the receiving spaces of one row is preferably constant. In a preferred embodiment, which results in the maximum possible resolution, the amount of offset is defined as the reciprocal value of the number of rows.

In another preferred embodiment the rectangular pattern of rows and columns is tilted to a degree in which at least a part of the receiving spaces of at least one row of the rectangular pattern is aligned with at least a part of the receiving spaces of at least one preceding row in the advance direction.

With this embodiment, a multiple strike of one and the same pixel to be applied onto the object is possible. That is, one and the same pixel may be applied to the object by different marking devices. The receiving spaces aligned in the advance direction preferably constitute receiving spaces of directly adjacent columns.

The multiple strike option provides a technology for a grey-scale marking or a colour marking by marking the same pixel on the object with two different marking devices. The multi strike option may also be advantageous in the case of an object having a surface that is difficult to be marked, for example a very hard surface to be engraved.

The marking or printing quality and/or the marking or printing resolution may be adjusted in that the marking head is rotatable about an axis perpendicular to the advance direction such that the amount of offset of the receiving spaces is adjustable. In particular, the marking head may be rotatable about an axis being perpendicular to a printing surface of the object to be printed. Alternatively or additionally, it is also possible to rotate the array of receiving spaces/marking devices with regard to the marking head.

In a preferred embodiment, the marking apparatus comprises a control unit for automatically controlling the tilting angle in order to produce solid horizontal lines, i.e. solid lines in a direction perpendicular to the advance direction.

For a precise movement of the marking head it may be preferred that a stepper motor is provided for rotating the marking head at defined small angle steps in the range of 0 to 90 degrees. The small angle steps may be in particular steps of less than 1 degree, preferably less than 0.1 degrees.

It may be preferred that at least one receiving space is equipped with a marking or printing device, in particular a laser printing device, a laser engraving device, an inkjet printing device, a needle printing device, a micro pad printing device, a water jet device and/or an electrical discharge machining device. In order to apply different types of markings to one object, it may be preferred that the receiving spaces are equipped with different types of marking devices. In this regard it may be preferred that the marking devices arranged in one column are of the same type.

In a preferred embodiment at least one receiving space is equipped with an optical fibre being coupleable to a light emitting device, with a laser diode and/or with a mirror element.

The light emitting device coupled to the optical fibres may in particular be a laser, which may comprise a plurality of laser elements, for example laser diodes. The fibre ends are preferably mounted to a ferrule, which is mounted to the receiving spaces.

The marking head can also be constructed as a monolithic element in which the marking devices form an integral part of the marking head.

Generally, all receiving spaces of the marking head may be equipped with individual marking devices. For a flexible adjustment of the marking head to a specific marking task, it may be preferable that—besides the possibility of entirely filling the receiving spaces with marking devices—the receiving spaces are configured to be partially equipped with marking devices for performing a marking operation. In this regard the marking head may be operable with an only partially filled array of receiving spaces.

It may be preferred that the marking head comprises a receiving plate with a plurality of receiving holes as receiving spaces. The marking devices, for example individual fibre ferrules with fibre ends or individual laser diodes, may be placed and fixed in the receiving spaces. It may be preferred that the receiving holes are through-holes, into which the marking devices may be inserted.

In a preferred embodiment at least a part of the receiving holes has a circular cross section. The circular cross-section allows for a very good and tight connection of individual fibre-ferrules. In this regard, it is preferred that the ferrules have a circular outer shape corresponding to the circular cross-section of the receiving holes.

The ferrules may fit into the holes in medium or transition fit, such that it is possible that the ferrules may be placed in the receiving holes and removed thereof by using a simple hand tool. It may be preferred that no additional fixtures are needed to bond the ferrules into the holes.

For holding the ferrules tight and removable in the receiving holes, it may be preferred that a capture pad is arranged at at least one surface of the receiving plate. It may be preferred that the capture pad includes an elastic polymer, in particular a rubber and/or an elastomer. The capture pad may be preferably made of Viton® (a trademark of E. I. du Pont de Nemours and Company, Delaware, USA) or includes the material Viton®. The ferrules may be pushed through the capture pad and are then held in place by the capture pad as it closes the ferrule after insertion. The ferrules can be removed by simply pushing back through from one side of the receiving plate.

In a further preferred embodiment a lens array comprising a plurality of lenses is provided, wherein the lenses are arranged in a rectangular pattern of rows and columns corresponding to the rectangular pattern of rows and columns of the receiving spaces. The lens array may be formed as a single unit or as individual lens inserts to be coupled to the receiving spaces of the marking head.

It is also possible to arrange a single lens instead or in addition to the lens array. In another preferred embodiment individual lenses may be inserted into the receiving holes of the receiving plate. Such lenses can in particular be collimator lens inserts.

In a further preferred embodiment at least one shielding device is provided at a circumference of the marking head for shielding radiation, the at least one shielding device comprising at least two brush rings arranged concentrically to each other.

The brush rings comprise an inner brush ring and an outer brush ring. The inner brush ring may include glass fibres and the outer brush ring may include nylon, in particular black nylon. The glass fibres of the inner brush ring may break, spread and dilute a laser light of the marking devices. The outer brush ring may absorb any low density diluted light that potentially might pass the inner ring.

An inventive method is characterized in that the marking devices are arranged in a plurality of rows and columns, such that an array of marking devices with a rectangular pattern of the marking devices is formed, and the marking is applied while the array of marking devices is tilted with regard to the advance direction such that the rows extend in a transverse direction relative to the advance direction and the marking devices of a successive row of the rectangular pattern are offset with regard to the marking devices of a preceding row of the rectangular pattern in a direction perpendicular to the advance direction.

With an inventive method, the advantages discussed in connection with the marking apparatus may be achieved. In particular it is possible to achieve a high marking speed with a high resolution.

In connection with an inventive method for marking it may be preferred that a tilting angle of the array of marking devices is modified during a marking operation and/or in between two marking operations. An idea of this preferred embodiment is that the tilting angle of the rectangular pattern of rows and columns is varied or changed during a marking operation in order to adjust a marking quality and/or resolution and/or to change between a single strike option and a multi strike option or vice versa. In the multi strike option the marking head is arranged such that one and the same pixel may be applied to the object by multiple marking devices.

The invention will be further described with reference to the attached Figures, wherein

DETAILED DESCRIPTION OF THE INVENTION

Figure 1:
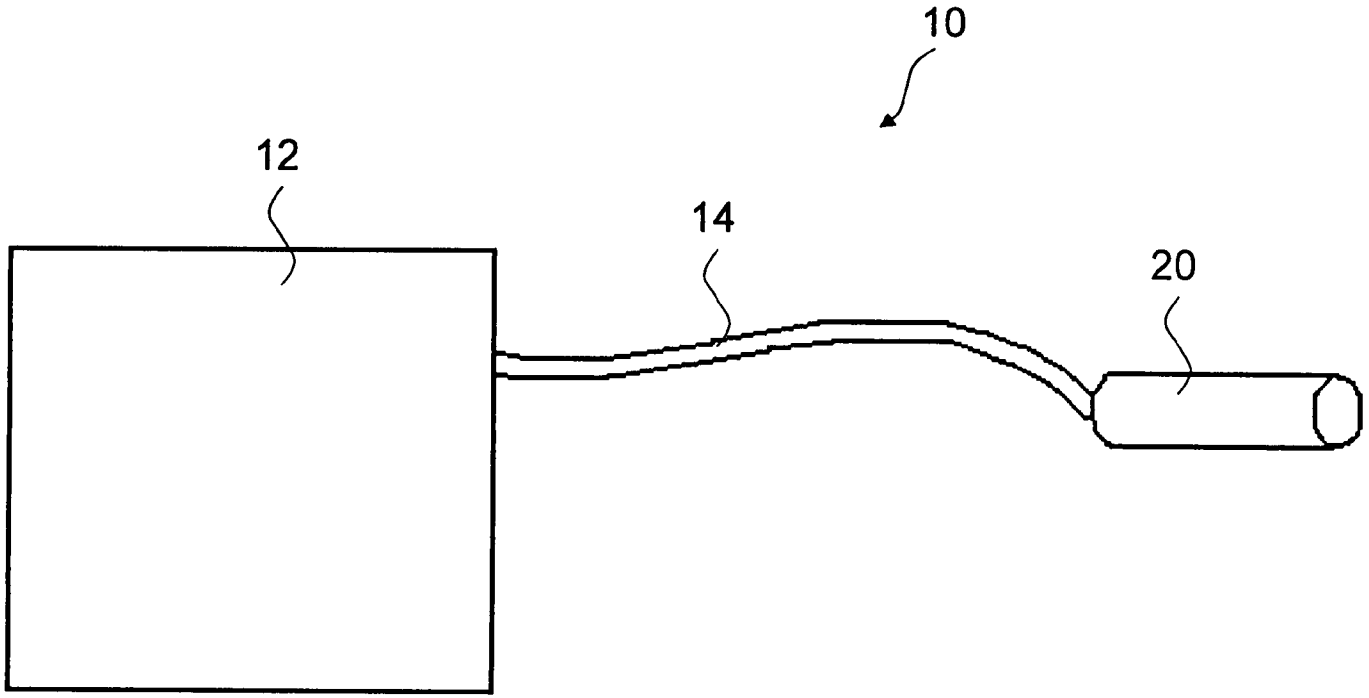
FIG. 1 shows an inventive marking apparatus.

A structure of an inventive marking apparatus 10 is shown in FIG. 1. The marking apparatus 10 comprises a marking device control and driving unit 12 and a marking head 20 that is connected to the marking device control and driving unit 12 through an umbilical 14. The marking apparatus 10 may in particular be a matrix or pixel printer.

Figure 2:
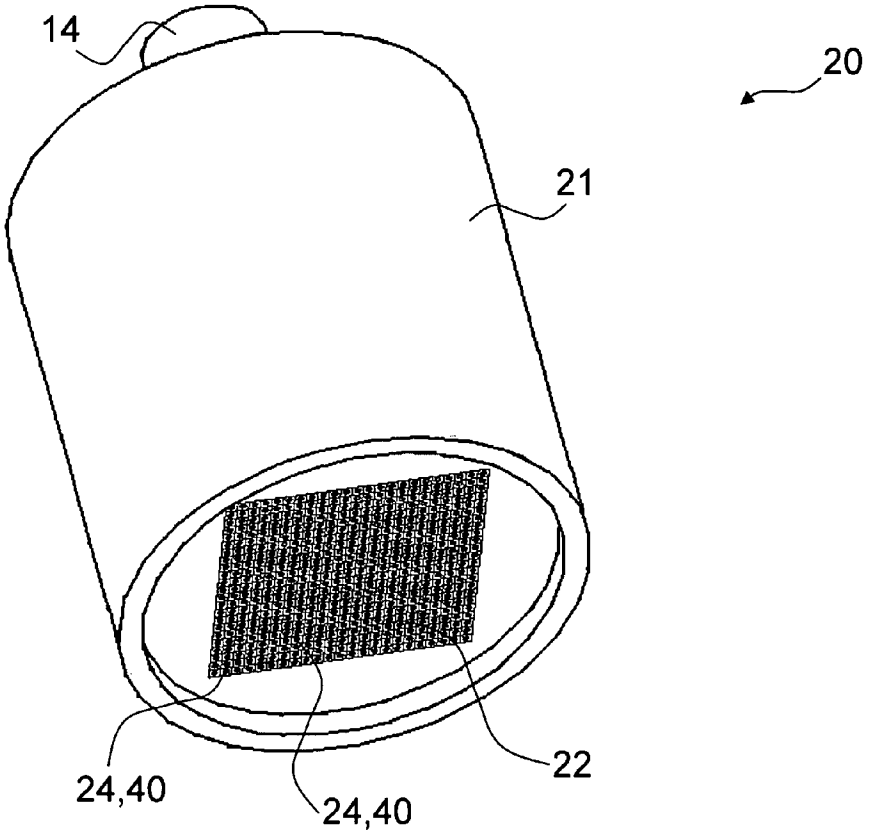
FIG. 2 shows a perspective view of an inventive marking head.

FIG. 2 shows a general structure of a marking head 20, which can in particular be a printing head. The marking head 20 comprises a housing 21, which in the shown embodiment has a cylindrical outer shape. At a first front face of the cylindrical marking head 20 a plurality of receiving spaces 24 is arranged in a regular rectangular pattern. The receiving spaces 24 are populated with individual marking devices 40, which may in particular be printing devices, such as laser diodes or fibre ends coupled to a laser.

The rectangular pattern of receiving spaces 24 and marking devices 40, respectively, forms a two-dimensional array 22, in particular with a rectangular outer shape. In the two-dimensional array 22 the receiving spaces 24 and marking devices 40, respectively, are arranged in rows 30 and columns 32 extending perpendicularly to each other.

Figure 3:
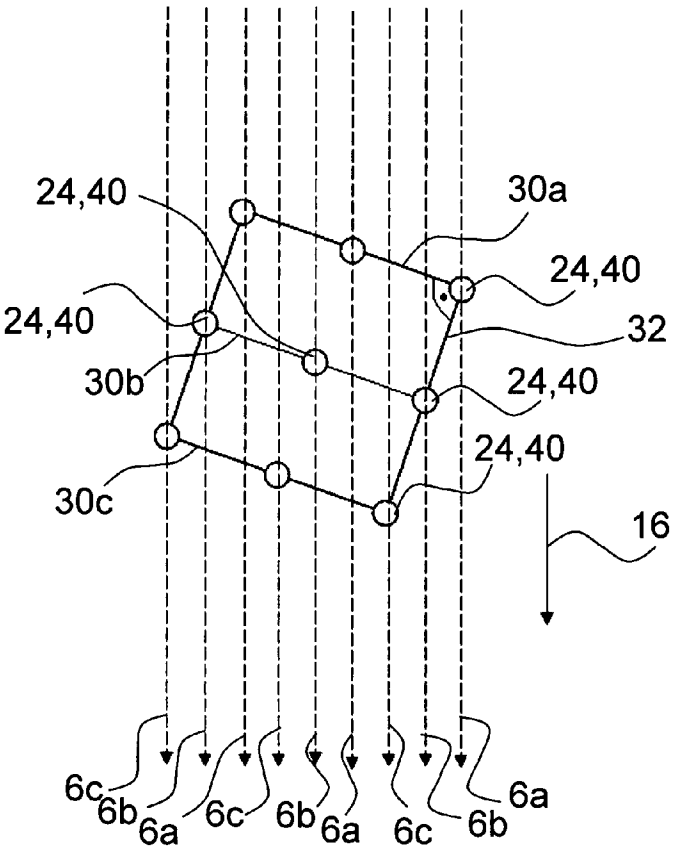
FIG. 3 shows the general principle of the inventive marking apparatus and method.

A general principle of a marking operation is shown in FIG. 3. The marking head 20 is arranged in a tilted or inclined position with regard to an advance direction 16 of an object 8 to be marked or printed. In particular, in the tilted position of the marking head 20 the receiving spaces 24 of different rows 30 are offset with regard to the advance direction 16. The receiving spaces 24 are equipped with individual marking devices 40.

The marking devices 40 of a first row 30*a* are arranged to apply first individual lines 6*a* spaced from one another in a direction perpendicular to the advance direction 16. A second row 30*b* is offset with regard to the first row 30*a* such that the marking devices 40 of the second row 30*b* are arranged to apply second individual lines 6*b* spaced from one another and spaced from the first individual lines 6*a* in a direction perpendicular to the advance direction 16. The marking devices 40 of a last row 30*c* are arranged to apply individual lines 6*c* spaced from one another and spaced from all preceding lines 6*a*, 6*b* in a direction perpendicular to the advance direction 16.

Figure 4:
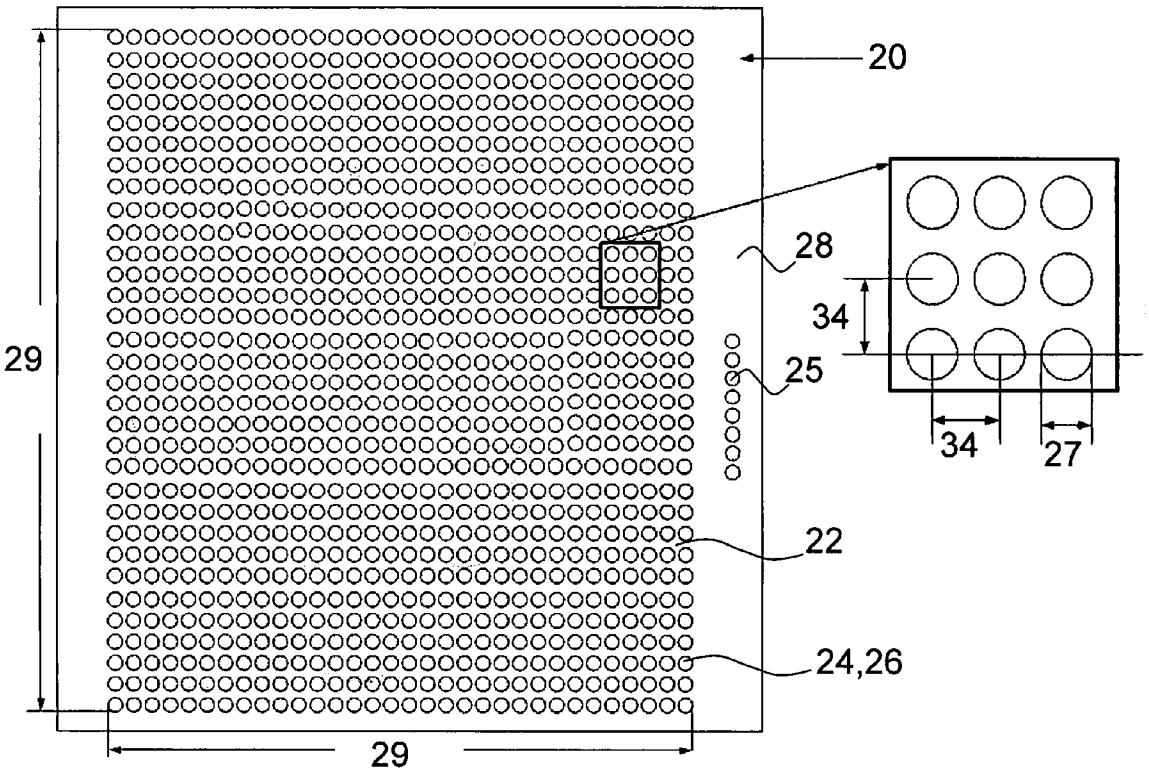
FIG. 4 shows an array of receiving spaces for marking devices.

An array 22 of receiving spaces 24 of a marking head 20 is shown in FIG. 4. The receiving spaces 24 are formed in a receiving plate 28, which may be a metal plate, for example a steel plate, for example with a thickness of approximately 5 mm. The receiving spaces 24 are formed as circular receiving holes 26 in the receiving plate 28, in particular through holes with a circular cross-section.

In a preferred embodiment the array 22 of receiving spaces 24 has a device pitch 34 in the row direction and in the column direction of about 1 to 4 mm, the device pitch 34 being defined as the distance between the central points of two adjacent receiving spaces 24 in one row 30 or column 32, respectively.

It may be preferred, that each of the receiving holes 26 has a diameter 27 of 1 to 3 mm.

In the shown embodiment, the receiving plate 28 comprises an array 22 of receiving spaces 24 arranged in a regular square pattern. The shown array 22 comprises 32 times 32 receiving spaces 24 with a device pitch 34 of 3.2 mm and a diameter 27 of the receiving spaces 24 of 2.0 mm, resulting in a width 29 of the array 22 in the row and column direction of 102.4 mm.

In addition to the array 22 of receiving spaces 24, a plurality of spare receiving spaces 25 is provided for accommodating spare marking devices 41. The spare receiving spaces 25 are also formed as receiving holes in the receiving plate 28.

Figure 5:
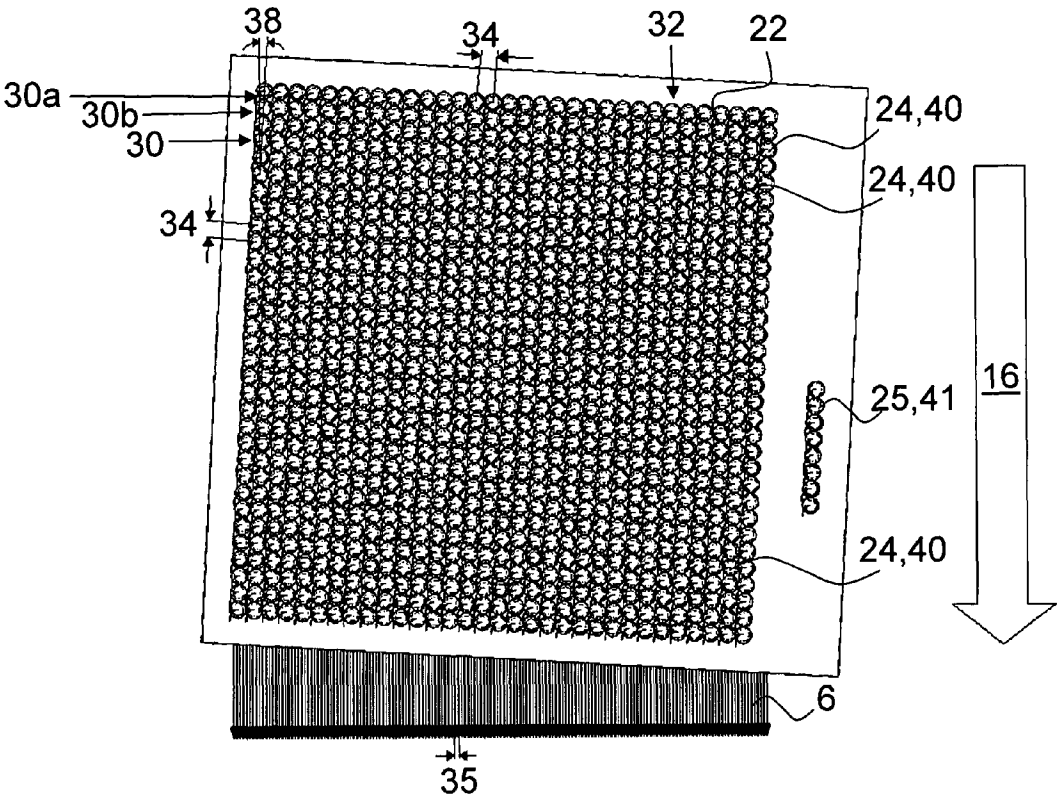
FIG. 5 shows a fully populated and tilted array.

In FIG. 5 a fully populated receiving plate 28 is shown in a tilted or inclined position. The tilted position is defined in particular in that the rectangular pattern of rows 30 and columns 32 is tilted from a position in which the columns 32 are aligned with the advance direction 16 to a position in which the columns 32 are slanted with regard to the advance direction 16.

The tilted position of the array 22 enhances the maximum possible resolution of the marking or printing. A first row 30*a* of marking devices 40 may apply a marking with a resolution in the transverse direction according to the number of marking devices 40 in the first row 30*a*. That is, if the first row 30*a* comprises 32 marking devices 40, the maximum resolution in the transverse direction is 32 lines or pixels. Due to the tilted position of the array, a second row 30*b* is staggered with regard to the first row 30*a* in the transverse direction, so that the marking devices 40 of the second row 30*b* may apply a marking in which the lines or pixels are offset with regard to the lines or pixels of the first row 30*a*. Thus, the resolution of the marking is doubled, if the first and second rows have the same number of marking devices 40.

A third row and successive rows 30 are also staggered with regard to any of the preceding rows 30, so that the resolution is further enhanced. The maximum possible resolution is defined by the product of the number of marking devices 40 per row and the number of marking devices 40 per column. For example, if the marking head 20 has 32 times 32 marking devices 40 arranged in a slanted array 22, the maximum resolution is 1024 pixels in the transverse direction, in particular a direction perpendicular to the advance direction 16.

With the tilted array 22 of marking devices 40 a print line or marking line pitch 35 being a distance between two adjacent marking or print lines is smaller than the device pitch 34.

Figure 6:
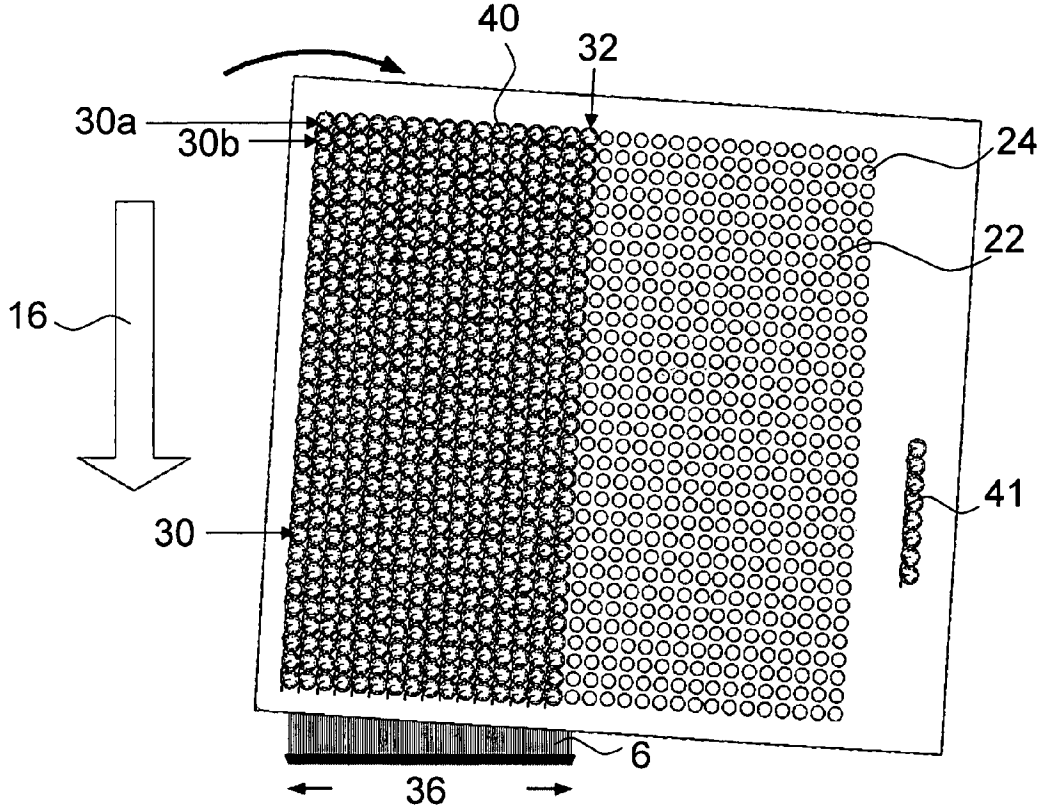
FIG. 6 shows a partially filled and tilted array.
Figure 7:
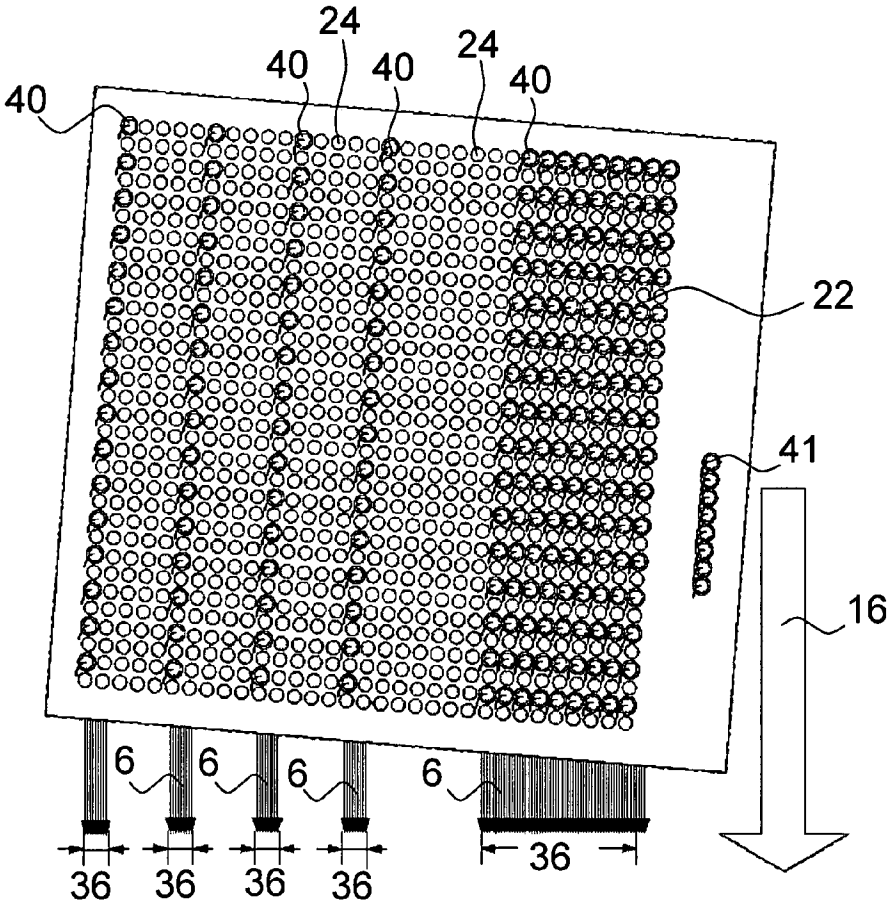
FIG. 7 shows another partially filled and tilted array.
Figure 8:
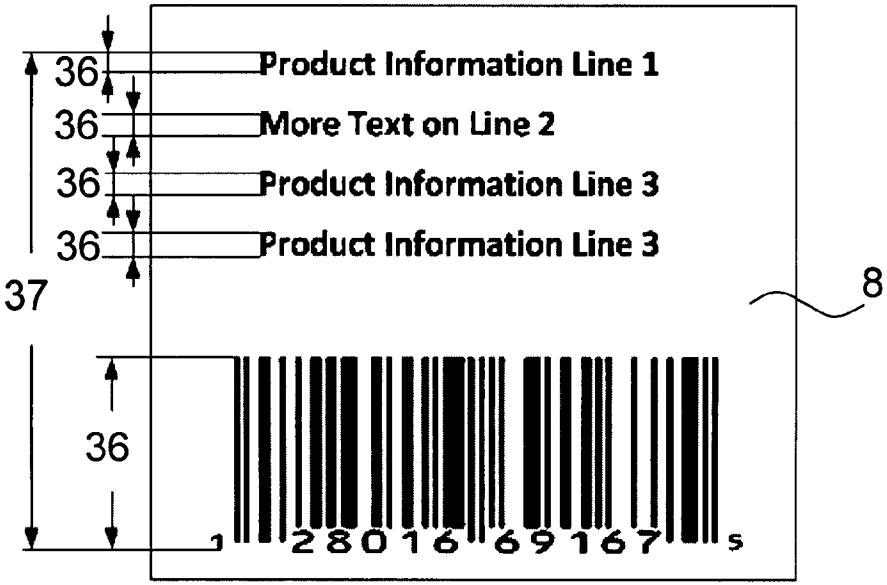
FIG. 8 shows an object having been marked using the array according to FIG. 7.

FIGS. 6 and 7 show embodiments of a marking head 20 that is only partially filled with marking devices 40, wherein the marking devices 40 are preferably all of the same type. The partial filling of the receiving spaces 24 makes the marking head 20 very flexible for different marking tasks. As in the embodiment of FIG. 5, a marking width 36 is greater than a width of the array 22 of marking devices 40 in a row direction. An example of an object 8, which has been marked or printed with the marking head 20 according to FIG. 7, is shown in FIG. 8. The total marking width is identified with the reference numeral 37.

Figure 9:
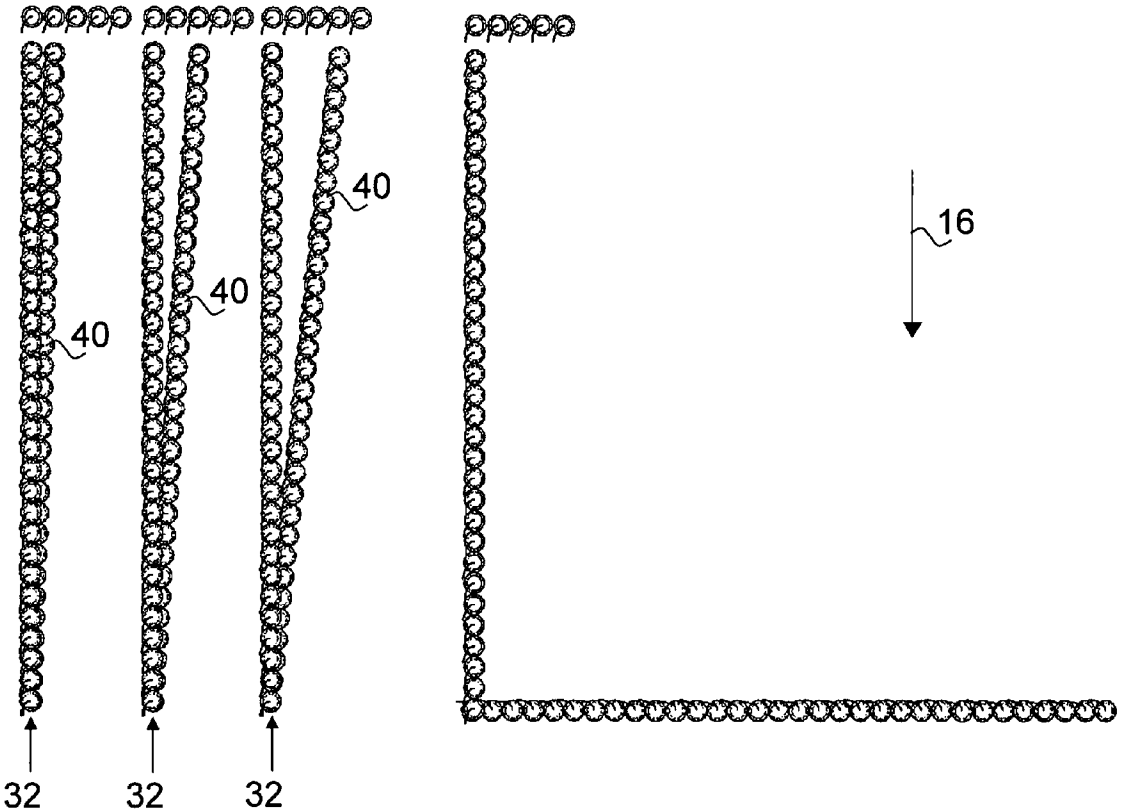
FIG. 9 shows the general principle of a multiple strike option.

FIG. 9 schematically shows different tilting angles 38 (cf. FIG. 5) of a marking device array 22. In the left representation of FIG. 9 the array 22 is tilted to a degree such that each of the marking devices 40 of one column 32 is arranged to apply a pixel that is offset with regard to any of the pixels being applied or printed by any of the other marking devices 40 of the same column 32. That is, the marking devices 40 of one column 32 are offset with regard to any other marking devices 40 of the same column 32. With this configuration the maximum resolution of a given marking head 20 may be achieved.

In the middle representation the array 22 is tilted to a degree in which a double strike of any pixel is possible. That is, the marking devices 40 of one column 32 correspond to the marking devices 40 of another column 32 such that one and the same pixel may be applied or printed by two different marking devices 40 arranged in different columns 32.

In the right representation the array 22 is tilted to a degree in which a triple strike of any pixel is possible. That is, the marking devices 40 of one column 32 correspond to the marking devices 40 of two other columns 32 such that one and the same pixel may be applied or printed by three different marking devices 40 arranged in different columns 32.

Figure 10:
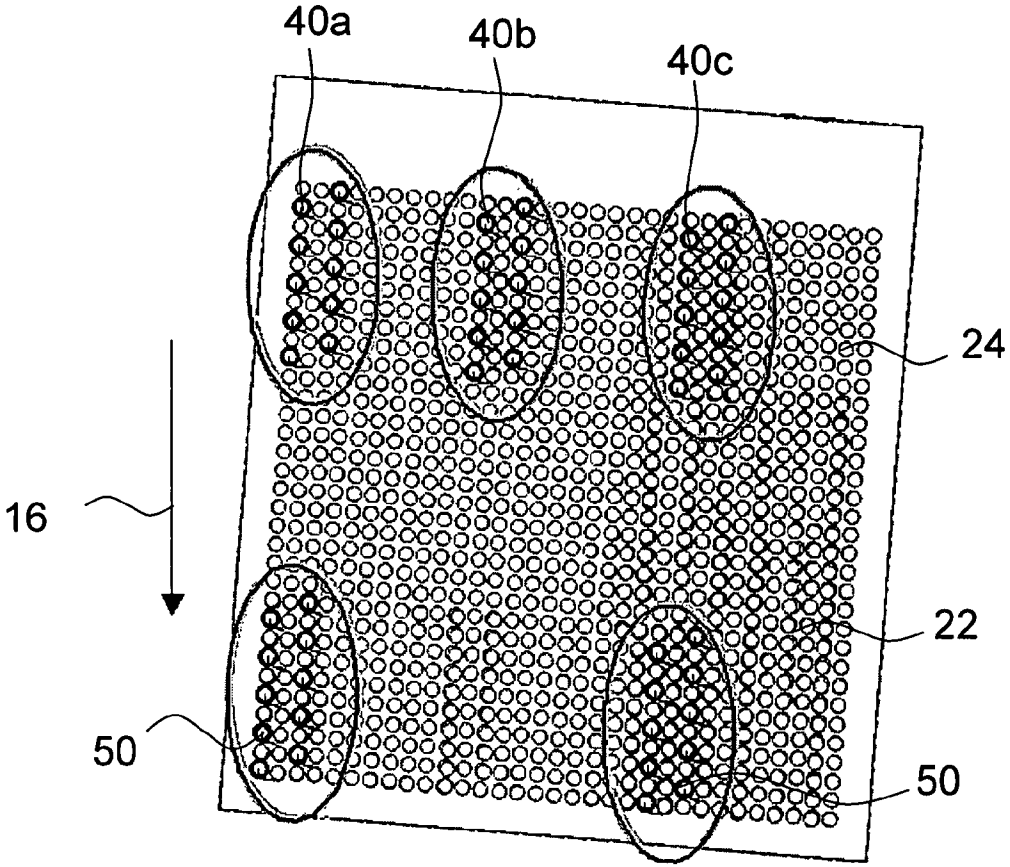
FIG. 10 shows a tilted array partially filled with marking devices of different kinds.
Figure 11:
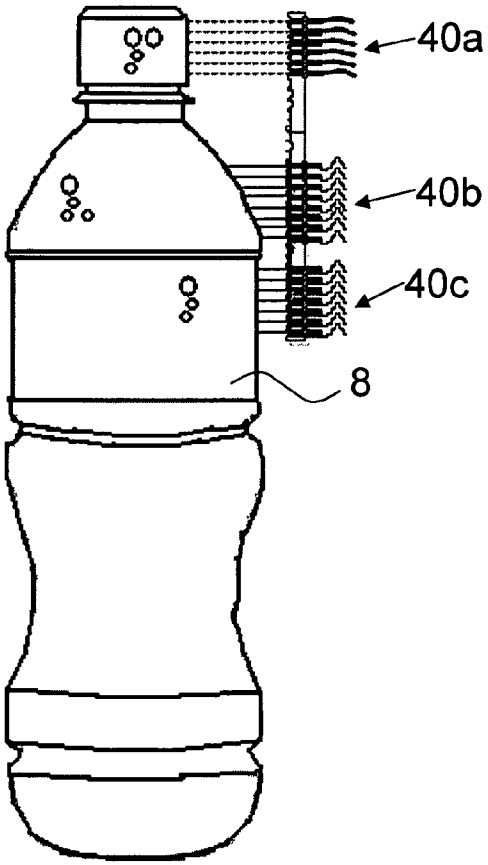
FIG. 11 shows an object having been marked using the array according to FIG. 10.

FIG. 10 shows a partially filled marking head 20 with different kinds of marking devices 40 arranged in the receiving spaces 24. The different kinds of marking devices 40 may for example be ink jet nozzles 40*a*, CO2 laser ferrules 40*b* and laser diode ferrules 40*c*. The different kinds of marking devices 40 may be used to perform different printing operations. For example the ink jet nozzles 40*a* may be used to print on a PVC cap, as shown in FIG. 11. The CO2 ferrules 40*b* may be used to print on an object 8 having varying distances to the marking devices 40. The laser diode ferrules 40*c* may be used to print on paper.

In addition to the marking devices 40, a plurality of sensor devices 50 may be arranged in the array 22.

Figure 12:
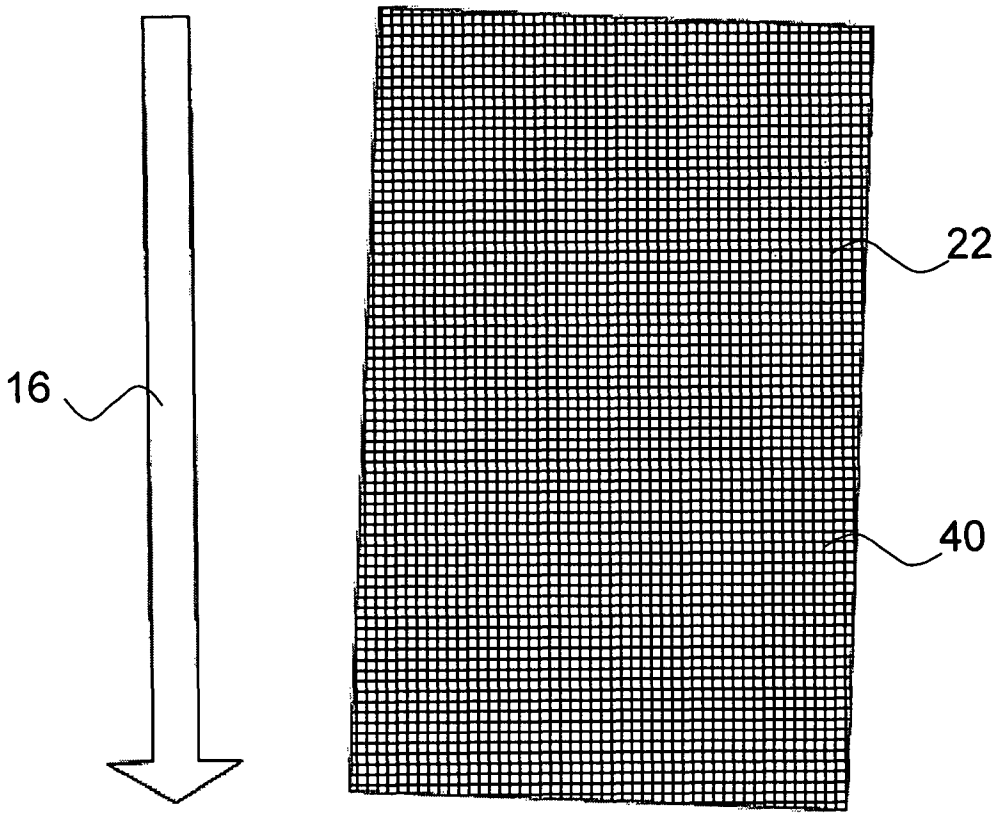
FIG. 12 shows an array of mirrors as marking devices.

FIG. 12 shows an array 22 of marking devices 40, wherein the marking devices 40 are mirror elements. The array 22 may for example be a digital micromirror device (DMD). The sides of the array 22 are cut such that a tilted array 22 is achieved, as shown in FIG. 12. The mirror elements may be used for controlling light beams, in particular laser beams for applying a marking onto an object 8.

Figure 13:
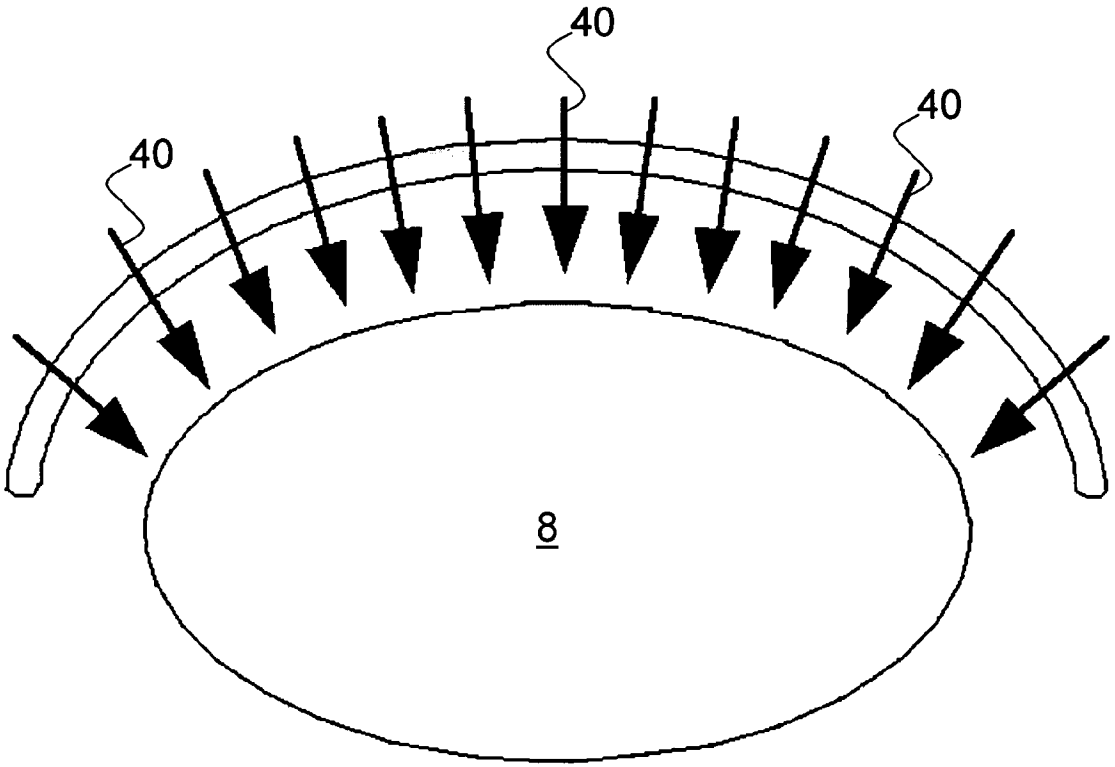
FIG. 13 shows an array of marking devices arranged in a curved surface.
Figure 14:
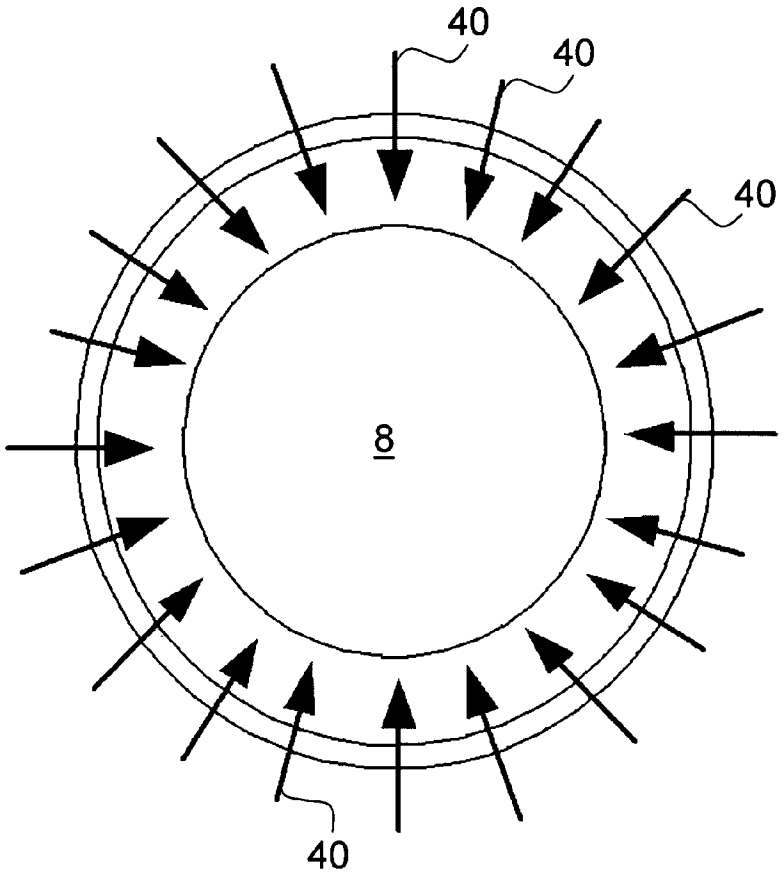
FIG. 14 shows another array of marking devices arranged in a curved surface.

The array 22 of receiving spaces 24 and marking devices 40, respectively, does not necessarily have to be a two-dimensional array 22. The receiving spaces 24 and marking devices 40, respectively, can also be arranged in a curved surface, as shown in FIGS. 13 and 14. Such three-dimensional structures may for example be used for marking bottles or similar objects 8. A closed three-dimensional structure as shown in FIG. 14 may for example be used for marking a cylindrical product.

Figure 15:
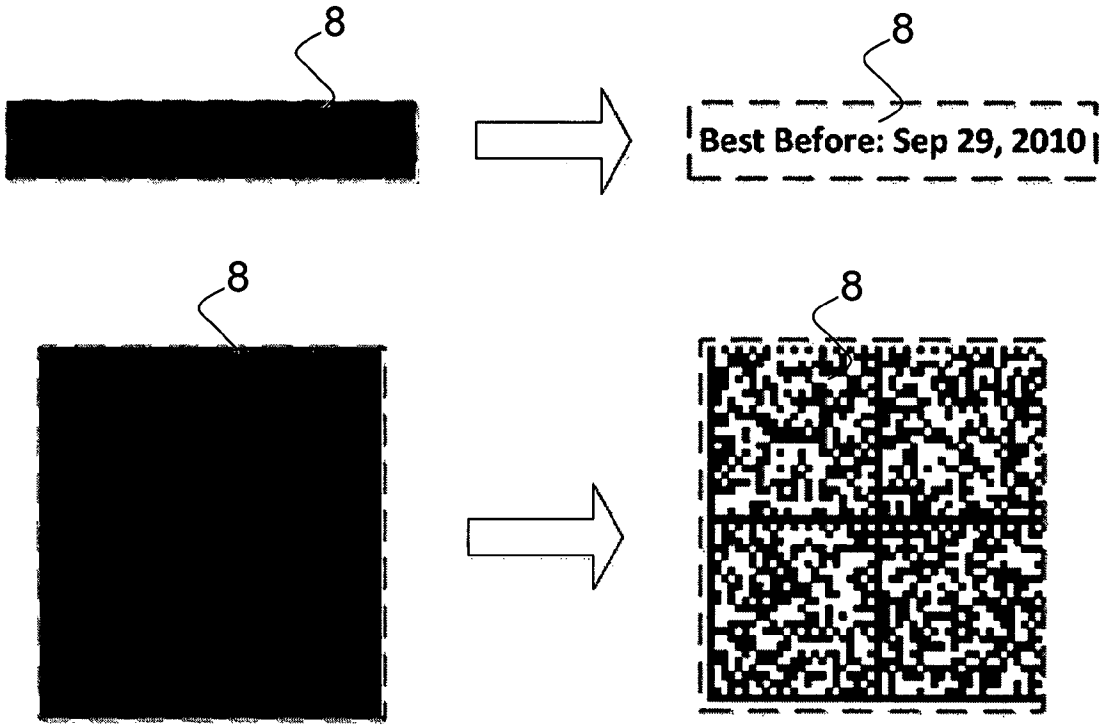
FIG. 15 shows a marking done by colour ablation.

In a preferred embodiment of the invention the marking is applied by colour ablation, an example of which is shown in FIG. 15. In a first step, a colour, for example black colour, is applied to an object 8 and in a second step the colour is ablated in a defined manner, so that a defined printing remains. This technology may also be referred to as inverse printing.

Figure 16:
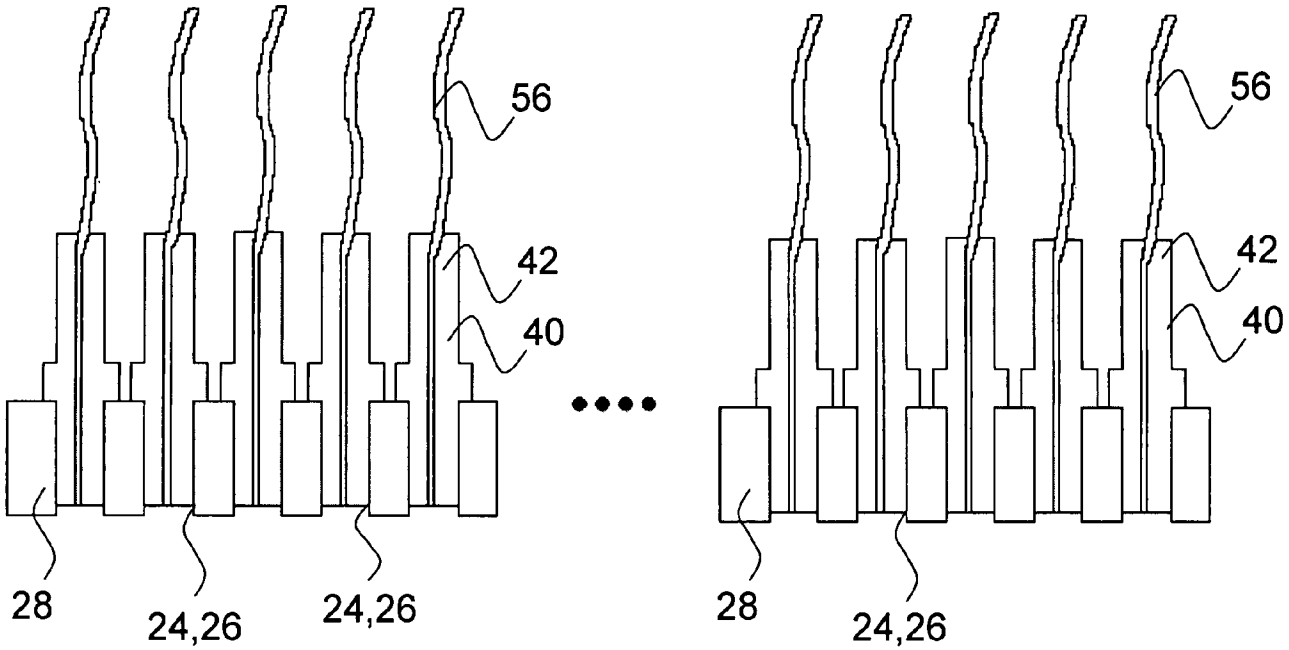
FIG. 16 shows a cross-sectional view of an array filled with fibre-ferrules.

FIG. 16 shows a cross-sectional view of a receiving plate 28 with receiving spaces 24, in which marking devices 40 are arranged. The receiving spaces 24 are formed as receiving holes 26, in particular through-holes. The marking devices 40 each comprise a fibre-ferrule 42, in which a fibre end of a fibre 56 is arranged. The ferrules 42 are mounted into the receiving holes 26.

Figure 17:
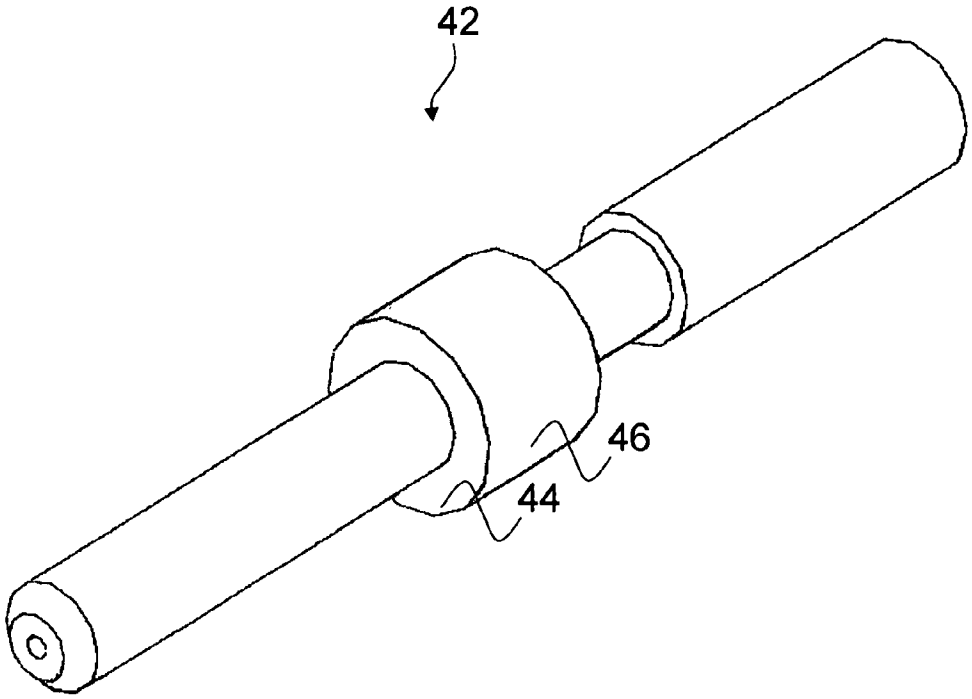
FIG. 17 shows a perspective view of a fibre ferrule to be inserted into a receiving space of a marking head.

A perspective view of a fibre-ferrule 42 is shown in FIG. 17. The fibre-ferrule 42 includes a substantially cylindrical body or insert made of metal—for example steal, ceramic, plastic or glass. It may be preferred that the ferrule 42 includes zirconia. The cylindrical body includes a collar 46 with an abutment surface 44 for contacting a planar surface of the receiving plate 28.

Figure 18:
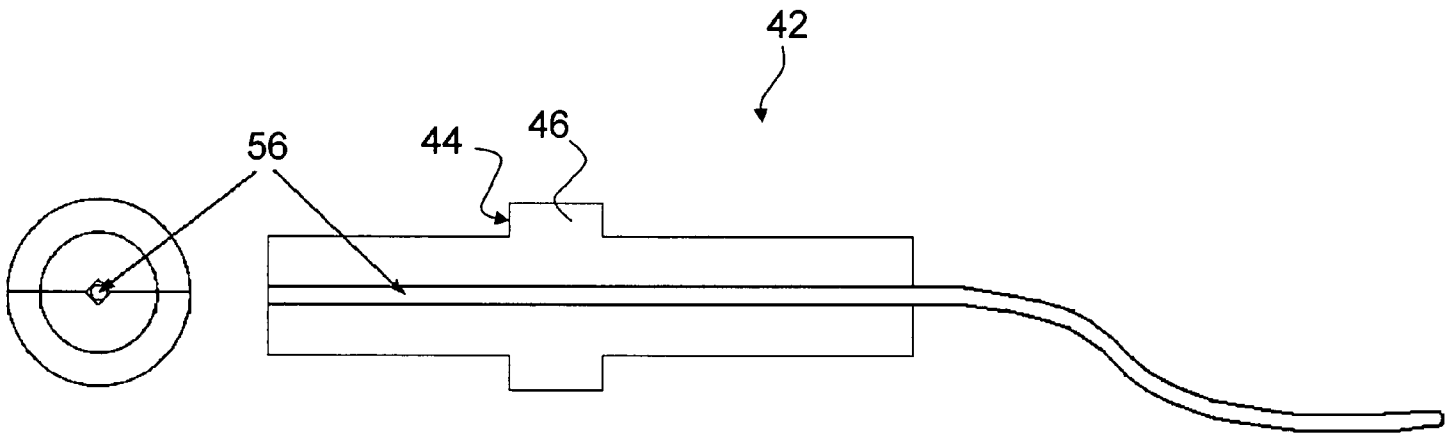
FIG. 18 shows sectional views a first embodiment of a fibre-ferrule.
Figure 19:
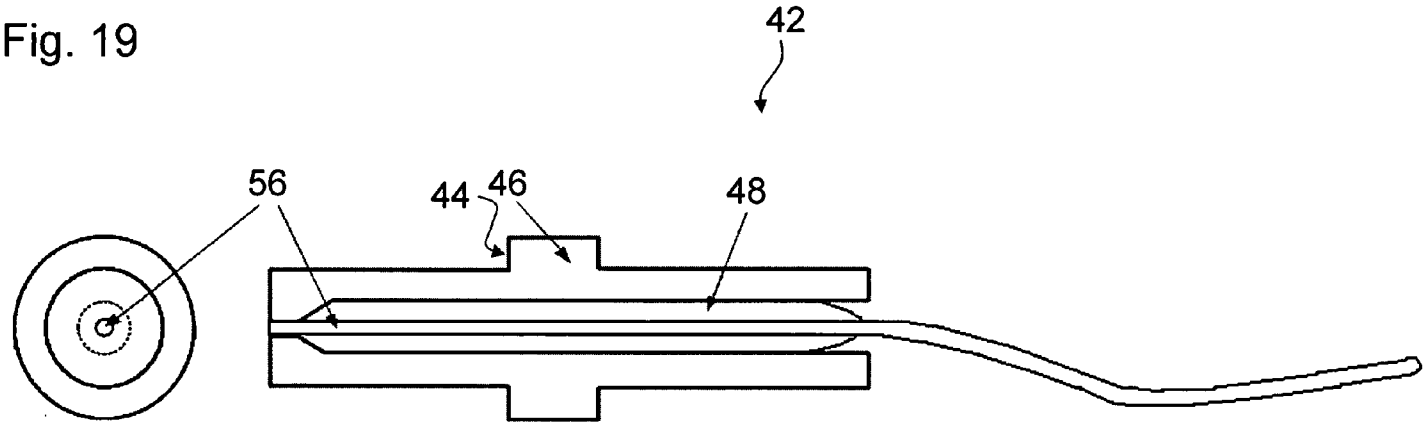
FIG. 19 shows sectional views of a second embodiment of a fibre-ferrule.

Different embodiments of fibre-ferrules 42 are shown in FIGS. 18 and 19. In a first embodiment shown in FIG. 18, the ferrule 42 has two half-cylindrical parts, each having a V-shaped groove formed therein. When the two parts of the ferrule 42 are mounted together, the V-shaped grooves form a receiving channel with a rectangular cross-section for a fibre 56.

In a second embodiment shown in FIG. 19, the ferrule 42 has a cylindrical receiving channel for the fibre 56. The receiving channel has a cross-section being wider than a cross section of the fibre 56. The fibre 56 is fixed in the receiving channel by inserting a filler 48, in particular a glue, into the receiving channel.

Figure 20:
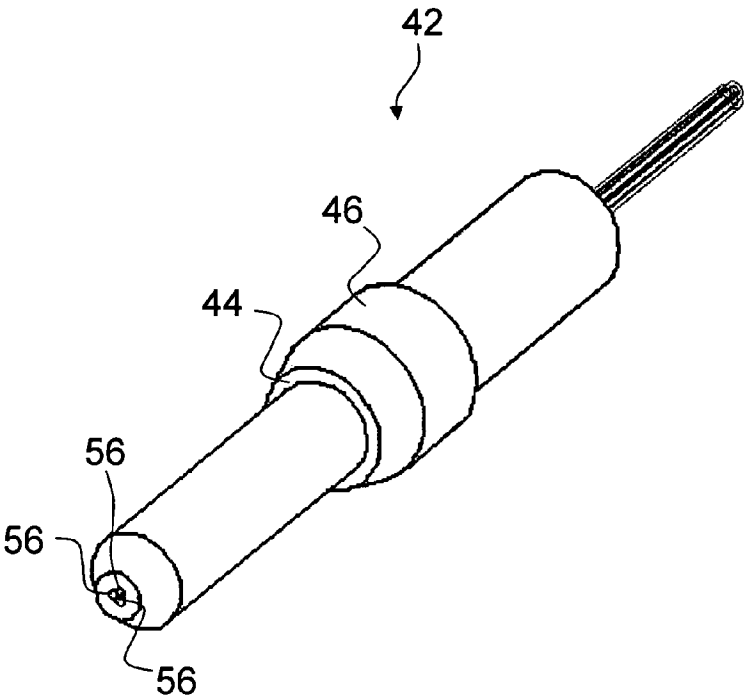
FIG. 20 shows a multi-fibre ferrule.

FIG. 20 shows a ferrule 42 with a plurality of fibres 56. Such a ferrule 42 may for example be used as a colour printing device, wherein the fibres 56 form a RGB grouping with the colours red, green and blue. For printing, the fibres 56 can be configured as step increases in power. That is, one, two or three fibres 56 emit depending on the power level needed to print a particular colour. In another configuration, the fibres are connected to laser diodes of different wavelengths for printing different colours.

Figure 21:
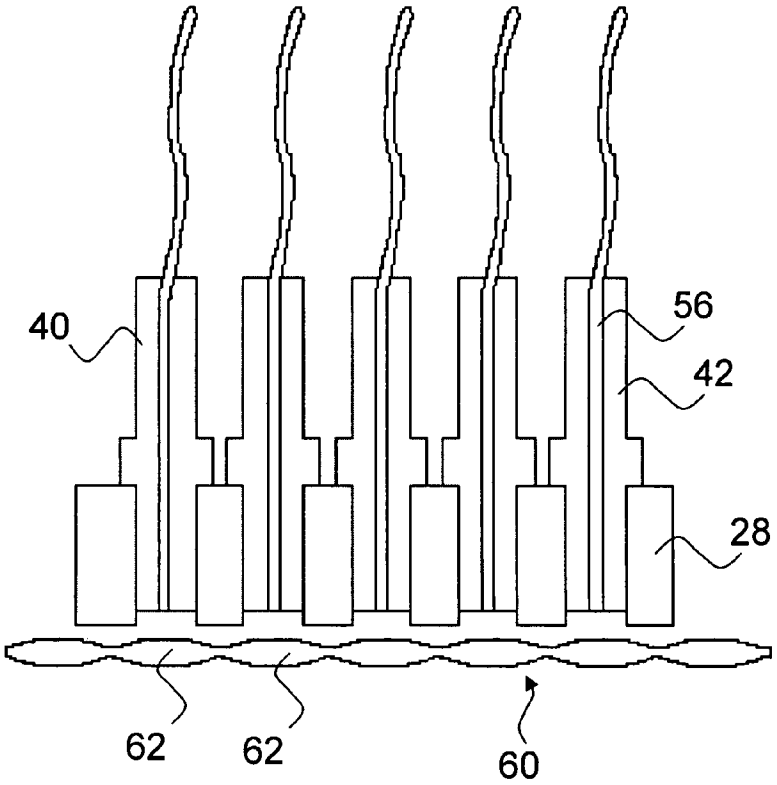
FIG. 21 shows a cross-sectional view of an array filled with fibre ferrules and a lens array.

FIG. 21 shows a marking head 20 with a lens array 60. The lens array 60 has the same pitch as the array 22 of receiving spaces 24.

Figure 22:
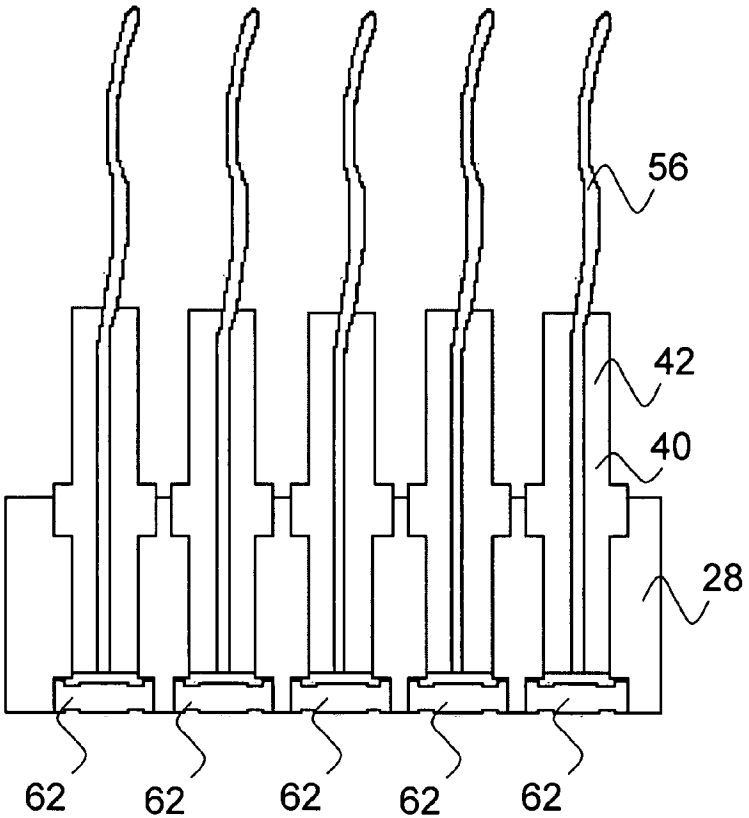
FIG. 22 shows a cross-sectional view of an array filled with fibre ferrules and a plurality of individual lens inserts and FIG. 23 shows a cross-sectional view of a shielding device.

A marking head 20 with individual lenses or lens inserts 62 inserted into receiving holes 26 of a receiving plate 28 is shown in FIG. 22. With the individual lenses 62, different focal distances for non-planar objects to be marked are possible. It is also possible to use mixed laser technologies.

Figure 23:
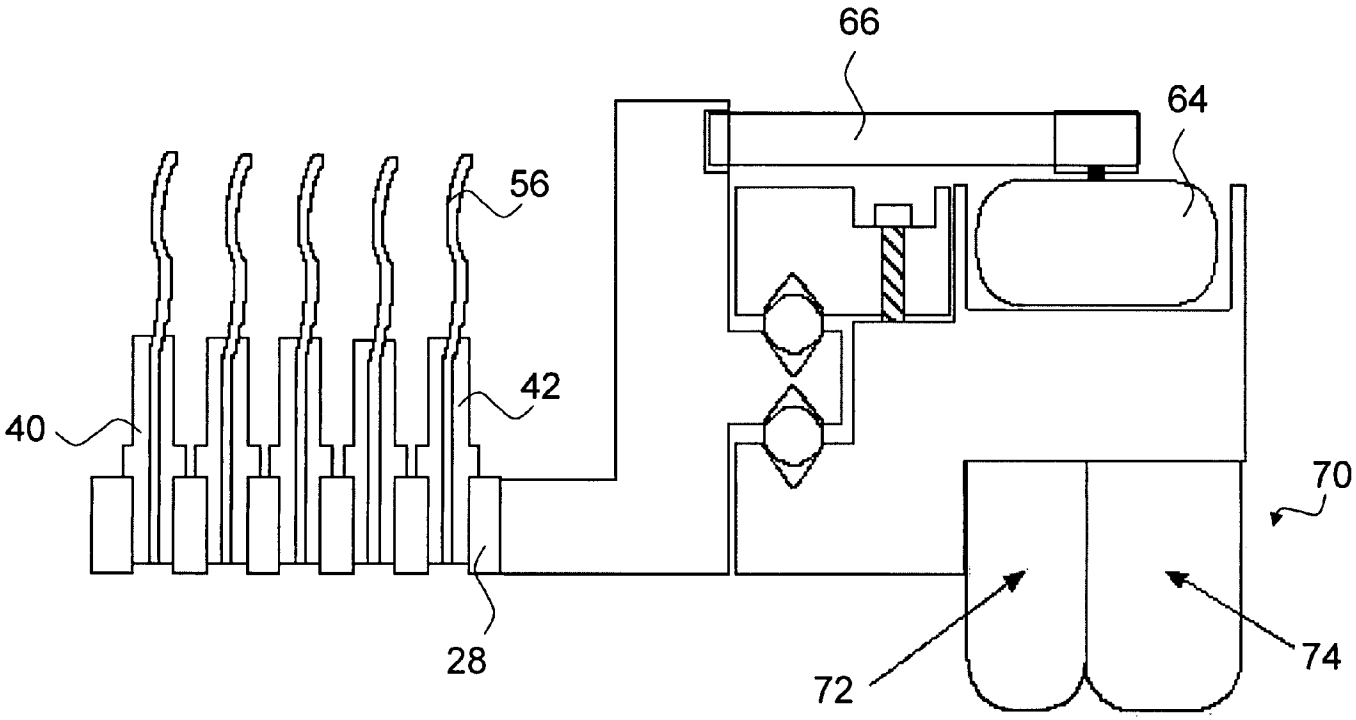

FIG. 23 shows a part of a marking head 20 with shielding device 70 for shielding radiation from a zone between the marking head 20 and an object 8 to be marked. The shielding device 70 comprises an inner brush ring 72 and an outer brush ring 74. The receiving plate 28 may be rotated by using a motor 64, which may in particular be a stepper motor. A transmission 66 is arranged between an output shaft of the motor 64 and the receiving plate 28. The transmission 66 comprises a belt connected to the motor 64 and the receiving plate 28 of the marking head 20.

The invention claimed is:

1. A marking apparatus for marking an object comprising:

a marking head having a plurality of receiving spaces for individual marking devices and a driving mechanism for providing a relative movement of the object relative to the marking head in an advance direction during a marking operation, wherein the receiving spaces are arranged in a plurality of rows and columns, such that an array of receiving spaces with a rectangular pattern of the receiving spaces is formed, and wherein the array of receiving spaces is tilted with regard to the advance direction such that the rows extend in a transverse direction relative to the advance direction and the receiving spaces of a successive row of the rectangular pattern are offset with regard to the receiving spaces of a preceding row of the rectangular pattern in a direction perpendicular to the advance direction, wherein the marking head comprises a receiving plate having a plurality of receiving holes formed as through-holes therein, the receiving holes forming the receiving spaces for the individual marking devices, the marking devices each include a ferrule which is insertable into a receiving hole of the receiving plate, and a capture pad with an elastic polymer is arranged at at least one surface of the receiving plate for holding the individual ferrules tight and removable in the receiving holes, wherein a lens array comprising a plurality of lenses is provided, wherein the lenses are arranged in a rectangular pattern of rows and columns corresponding to the rectangular pattern of rows and columns of the receiving spaces.

2. The marking apparatus of claim 1, wherein the receiving spaces are arranged in a regular rectangular pattern and the amount of offset of the receiving spaces of a successive row with regard to the receiving spaces of a preceding row is smaller than a pitch of the receiving spaces of one row.

3. The marking apparatus of claim 1, wherein the rectangular pattern of rows and columns is tilted to a degree in which at least a part of the receiving spaces of at least one row of the rectangular pattern is aligned with at least a part of the receiving spaces of at least one preceding row in the advance direction.

4. The marking apparatus of claim 1, wherein the marking head is rotatable about an axis perpendicular to the advance direction such that the amount of offset of the receiving spaces is adjustable.

5. The marking apparatus of claim 1, wherein a motor is provided for rotating the marking head.

6. The marking apparatus of claim 1, wherein at least one receiving space is equipped with a marking or printing device.

7. The marking apparatus of claim 1, wherein at least one receiving space is equipped with an optical fibre being coupleable to at least one of: a light emitting device a laser diode and a mirror element.

8. The marking apparatus of claim 1, wherein the receiving spaces are configured to be partially equipped with marking devices for performing a marking operation.

9. The marking apparatus of claim 1, wherein at least a part of the receiving holes has a circular cross-section.

10. The marking apparatus of claim 1, wherein at least one shielding device is provided at a circumference of the marking head for shielding radiation, the at least one shielding device comprising at least two brush rings arranged concentrically to each other.

11. The marking apparatus of claim 1, wherein the ferrules fit into the receiving holes in medium or transition fit.

12. A method for marking an object, with the marking apparatus of claim 1, wherein a marking is applied by a plurality of individual marking devices and the object is moved relative to the marking devices in an advance direction during a marking operation, the marking devices are arranged in a plurality of rows and columns, such that an array of marking devices with a rectangular pattern of the marking devices is formed, and the marking is applied while the array of marking devices is tilted with regard to the advance direction such that the rows extend in a transverse direction relative to the advance direction and the marking devices of a successive row of the rectangular pattern are offset with regard to the marking devices of a preceding row of the rectangular pattern in a direction perpendicular to the advance direction.

13. The method of claim 12, wherein a tilting angle of the array of marking devices is modified during at least one of: a marking operation and in between two marking operations.

* * * * *